US010980350B1

(12) United States Patent
Hutchings

(10) Patent No.: US 10,980,350 B1
(45) Date of Patent: Apr. 20, 2021

(54) DEVICE FOR CHANGING A PILLOWCASE

(71) Applicant: Joyce Hutchings, Cortland, NY (US)

(72) Inventor: Joyce Hutchings, Cortland, NY (US)

( * ) Notice: Subject to any disclaimer, the term of this patent is extended or adjusted under 35 U.S.C. 154(b) by 323 days.

(21) Appl. No.: 15/785,589

(22) Filed: Oct. 17, 2017

(51) Int. Cl.
*A47C 21/02* (2006.01)

(52) U.S. Cl.
CPC ..... *A47C 21/028* (2013.01)

(58) Field of Classification Search
CPC . A47C 21/028; A45D 8/242; Y10T 16/53607; Y10T 24/44376; Y10T 24/385; Y10T 24/44402; Y10T 24/4446; Y10T 24/24447
See application file for complete search history.

(56) References Cited

U.S. PATENT DOCUMENTS 1,140,583 A * 5/1915 Elliot ..... A47C 21/026 5/489
1,144,187 A 6/1915 Garren
1,712,711 A * 5/1929 Morgan ..... A47C 21/028 5/489
5,404,602 A * 4/1995 Kondo ..... A47C 21/022 24/499
5,673,446 A 10/1997 Moen
6,839,923 B2 1/2005 Blessman
7,958,580 B2 6/2011 Zorger
7,971,294 B1 7/2011 Murauskos
2004/0000030 A1* 1/2004 Pleiman ..... A45C 13/005 16/267
2006/0185086 A1 8/2006 Lucas

FOREIGN PATENT DOCUMENTS

GB 2488114 A 8/2012
WO 2004080248 A 9/2004

* cited by examiner

*Primary Examiner* — David R Hare
*Assistant Examiner* — Adam C Ortiz

(57) ABSTRACT

The device for changing a pillowcase is configured for use with a pillow. The device for changing a pillowcase is configured for use with a pillow case. The device for changing a pillowcase inserts the pillow into the pillow case. Specifically, the device for changing a pillowcase is an openwork structure within which the pillow is contained. Once the pillow is contained within the openwork structure, the openwork structure is inserted into the pillowcase. The openwork structure is opened releasing the pillow after which the openwork structure is withdrawn from the pillowcase. The device for changing a pillowcase comprises the openwork structure, a plurality of hinges, and a handle. The plurality of hinges and the handle are attached to the open work structure. The plurality of hinges open and close the openwork structure.

7 Claims, 6 Drawing Sheets

DEVICE FOR CHANGING A PILLOWCASE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of personal and domestic articles including beds and bedding, more specifically, a holder that facilitates the making of a bed.

SUMMARY OF INVENTION

The device for changing a pillowcase is configured for use with a pillow. The device for changing a pillowcase is configured for use with a pillow case. The device for changing a pillowcase inserts the pillow into the pillow case. Specifically, the device for changing a pillowcase is an openwork structure within which the pillow is contained. Once the pillow is contained within the openwork structure, the openwork structure is inserted into the pillowcase. The openwork structure is opened releasing the pillow after which the openwork structure is withdrawn from the pillowcase. The device for changing a pillowcase comprises the openwork structure, a plurality of hinges, and a handle. The plurality of hinges and the handle are attached to the open work structure. The plurality of hinges open and close the openwork structure. The handle is an apparatus that controls the device for changing a pillowcase.

These together with additional objects, features and advantages of the device for changing a pillowcase will be readily apparent to those of ordinary skill in the art upon reading the following detailed description of the presently preferred, but nonetheless illustrative, embodiments when taken in conjunction with the accompanying drawings.

In this respect, before explaining the current embodiments of the device for changing a pillowcase in detail, it is to be understood that the device for changing a pillowcase is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the device for changing a pillowcase.

It is therefore important that the claims be regarded as including such equivalent construction insofar as they do not depart from the spirit and scope of the device for changing a pillowcase. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
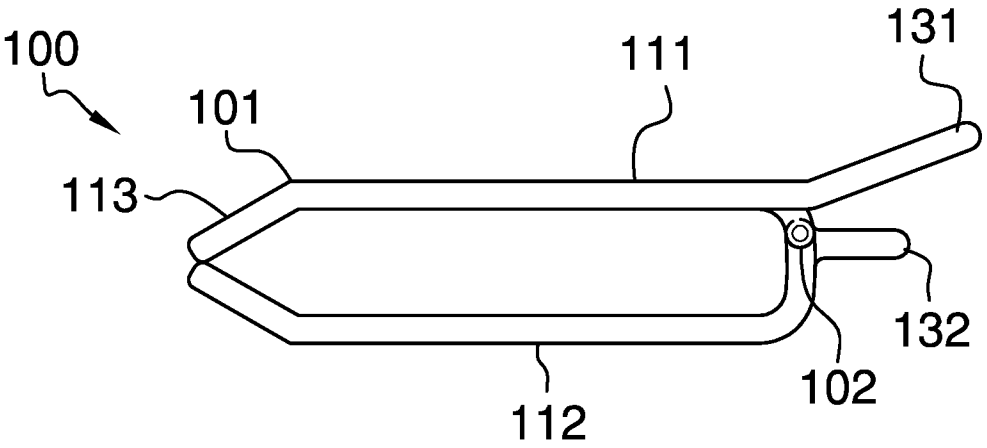
FIG. 1 is a side view of an embodiment of the disclosure.
Figure 2:
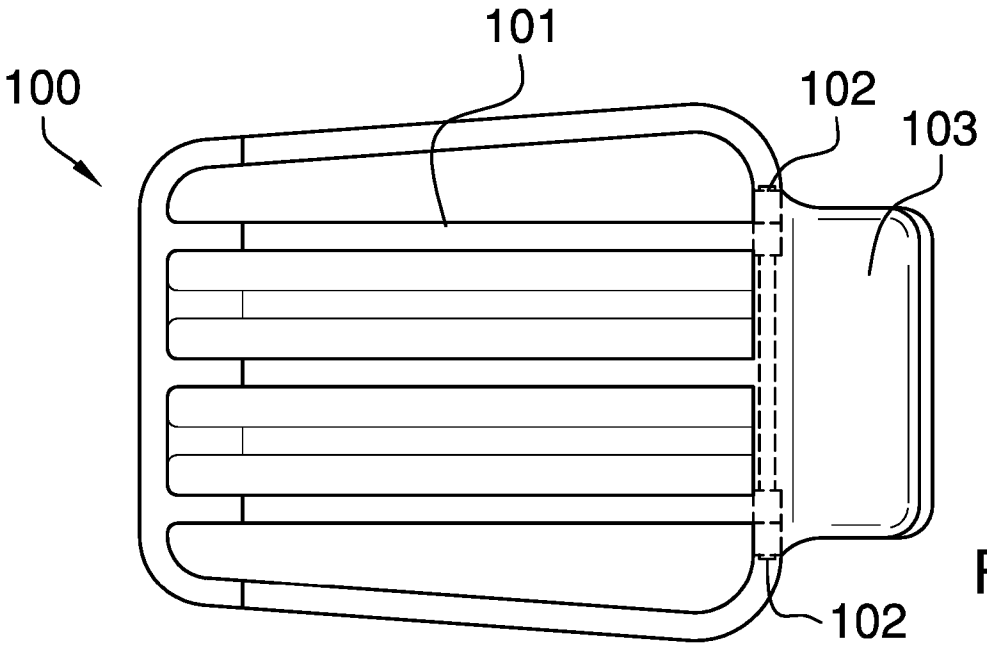
FIG. 2 is a top view of an embodiment of the disclosure.
Figure 3:
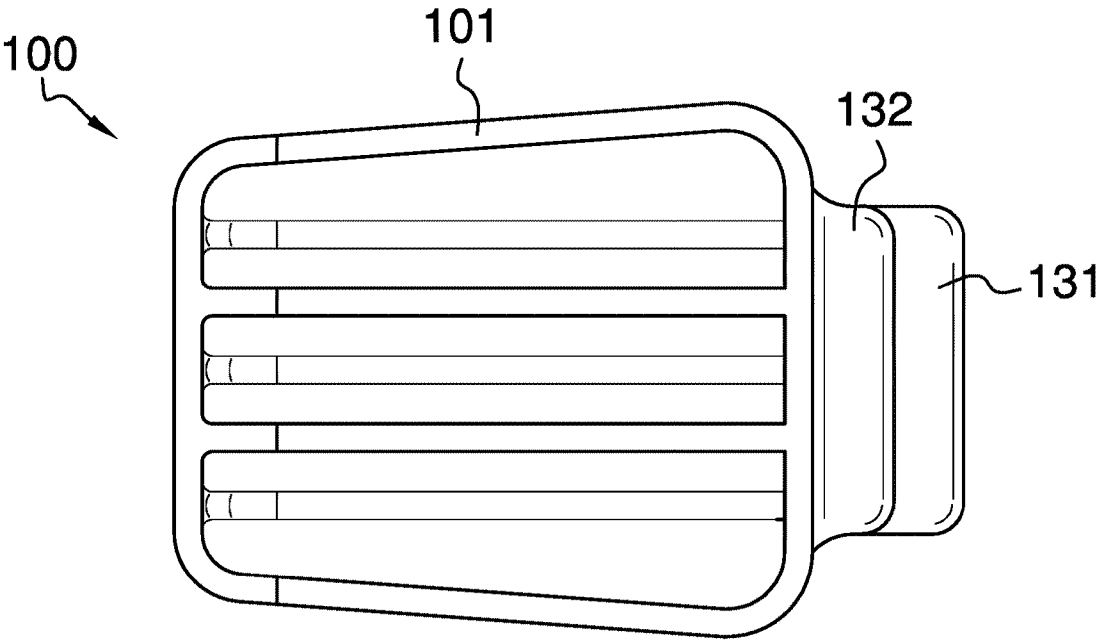
FIG. 3 is a bottom view of an embodiment of the disclosure.
Figure 4:
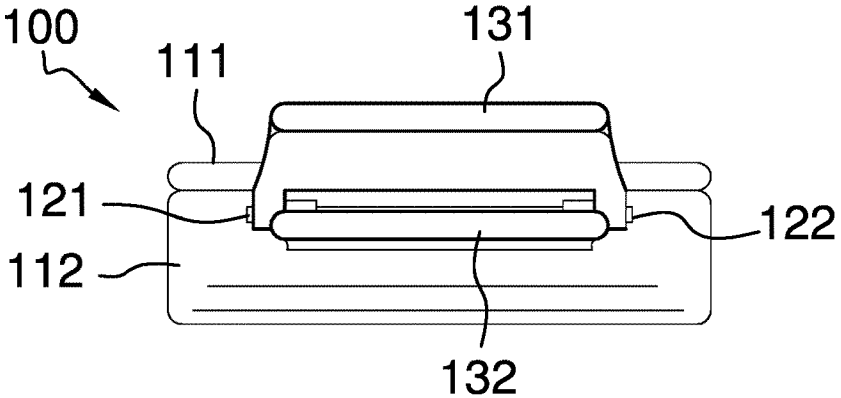
FIG. 4 is an end view of an embodiment of the disclosure.
Figure 5:
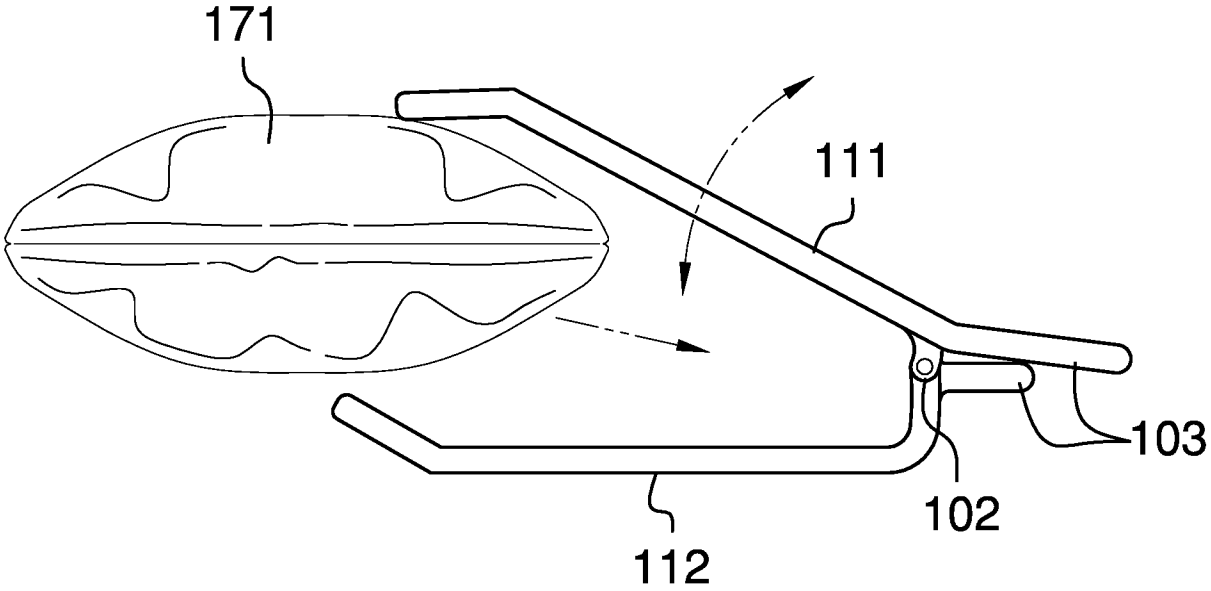
FIG. 5 is an in use view of an embodiment of the disclosure.
Figure 6:
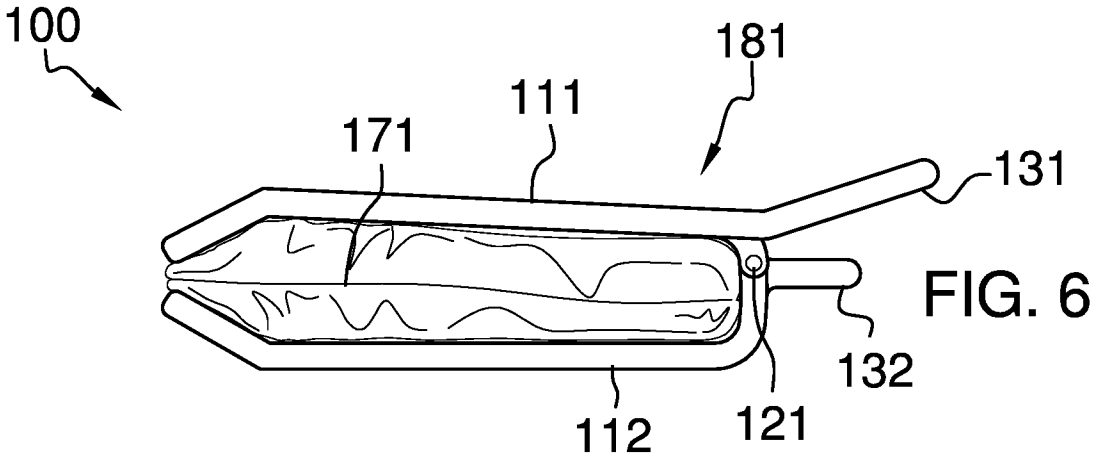
FIG. 6 is an in use view of an embodiment of the disclosure.
Figure 7:
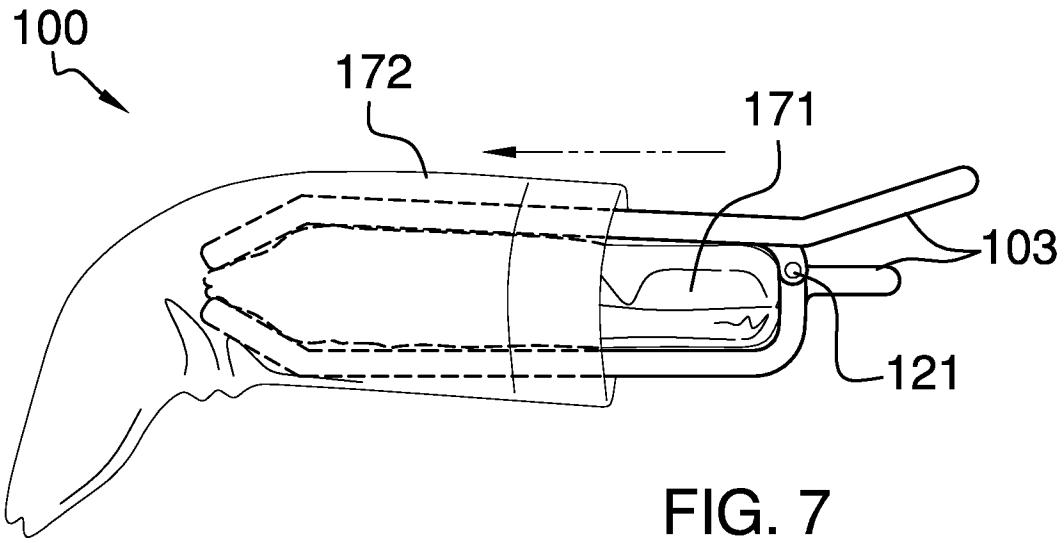
FIG. 7 is an in use view of an embodiment of the disclosure.
Figure 8:
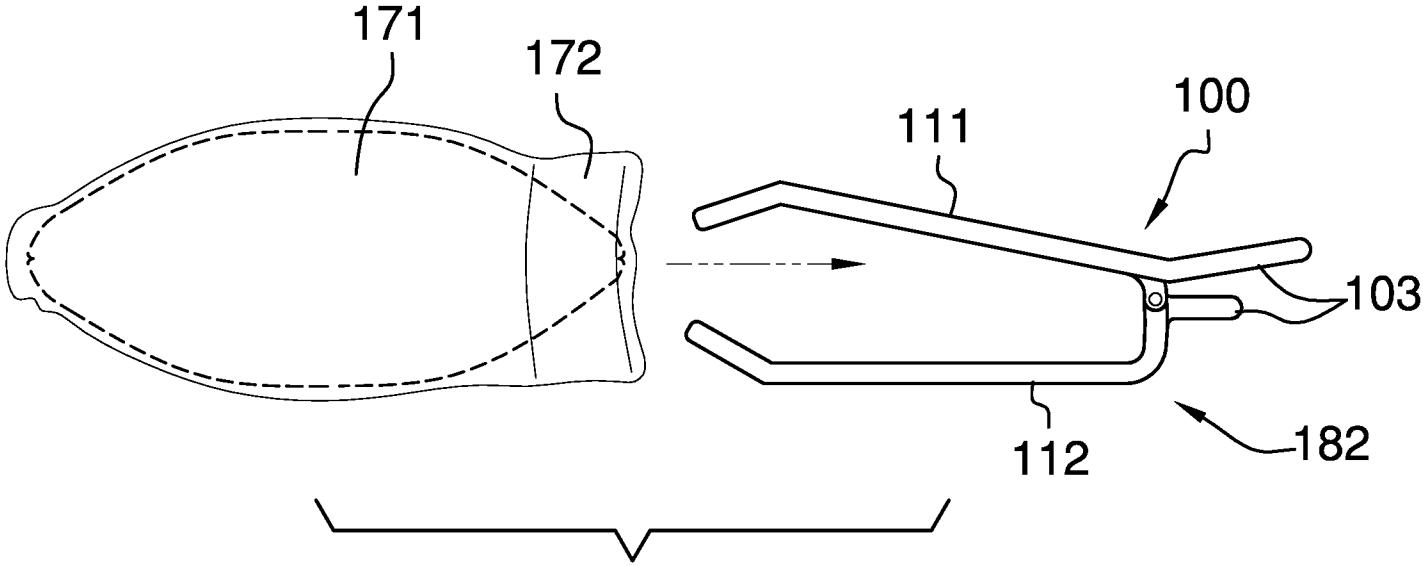
FIG. 8 is an in use view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 9.

The device for changing a pillowcase 100 (hereinafter invention) is configured for use with a pillow 171. The invention 100 is configured for use with a pillow 171 case 172. The invention 100 inserts the pillow 171 into the pillow 171 case 172. Specifically, the invention 100 is an openwork structure 101 within which the pillow 171 is contained. Once the pillow 171 is contained within the openwork structure 101, the openwork structure 101 is inserted into the pillow 171 case 172. The openwork structure 101 is opened releasing the pillow 171 after which the openwork structure 101 is withdrawn from the pillow 171 case 172. The invention 100 comprises the openwork structure 101, a plurality of hinges 102, and a handle 103. The plurality of hinges 102 and the handle 103 are attached to the open work structure. The plurality of hinges 102 open and close the openwork structure 101. The handle 103 is an apparatus that controls the invention 100.

The openwork structure 101 is a container within which the pillow 171 is placed before being inserted into the pillow 171 case 172. The openwork structure 101 compresses the pillow 171 for the purpose of minimizing the volume of the pillow 171 before insertion into the pillow 171 case 172. The openwork structure 101 uses an openwork construction for the purpose of minimizing friction between the openwork structure 101 and the pillow 171 case 172 during the insertion of the pillow 171. The openwork structure 101 comprises an encasing jaw 111 and a trap jaw 112. The openwork structure 101 is further defined with a closed position 181 and an open position 182. The trap jaw 112 is further defined with a lip 113.

The encasing jaw 111 is a roughly rectangular structure that forms the bulk of the containment space of the openwork structure 101. The encasing jaw 111 is formed with an open face such that the pillow 171 is placed within the encasing jaw 111 through the open face.

The trap jaw 112 encloses the open face of the encasing jaw 111 after the pillow 171 is placed within the encasing jaw 111. The structure of the trap jaw 112 is formed in the shape of an inverted tray. The lip 113 is a rim that is formed around the perimeter of the trap jaw 112 and contains the pillow 171 within the trap jaw 112. The lip 113 of the trap jaw 112 is formed such that: 1) a pillow 171 supported by the trap jaw 112 will readily slide off the trap jaw 112 when the trap jaw 112 is shaken; but, 2) a pillow 171 supported by the trap jaw 112 will not inadvertently fall off the trap jaw 112 when the trap jaw 112 is experiencing smooth motion. The trap jaw 112 is placed on the encasing jaw 111 such that the lip 113 projects away from the surface of the trap jaw 112 towards the encasing jaw 111.

To use the invention 100: 1) the pillow 171 inserts into the openwork structure 101; 2) the openwork structure 101 is placed in a closed position 181; 3) the openwork structure 101 inserts into the pillow 171 case 172; 4) the openwork structure 101 is placed in an open position 182; and, 5) the openwork structure 101 is withdrawn leaving the pillow 171 in the pillow 171 case 172.

In the first potential embodiment of the disclosure, once the openwork structure 101 containing the pillow 171 is inserted into the pillow 171 case 172, the orientation of the invention 100 relative to the force of gravity is inverted such that the trap jaw 112 forms the inferior surface of the invention 100. From this position, the openwork structure 101 can be opened using the handle 103 and the pillow 171 is removed from the trap jaw 112 by shaking the trap jaw 112 as the openwork structure 101 is removed from the pillow 171 case 172.

Each of the plurality of hinges 102 is a spring-loaded apparatus that: 1) holds the openwork structure 101 together; and, 2) allows the openwork structure 101 to open and close as required. The elements of the structure of each of the plurality of hinges 102 is distributed between the encasing jaw 111 and the trap jaw 112. In the relaxed shape, each of the plurality of hinges 102 holds the openwork structure 101 in the closed position 181. The plurality of hinges 102 comprises a first hinge 121 and a second hinge 122.

The first hinge 121 is a pivot based structure that attaches the encasing jaw 111 to the trap jaw 112 such that the trap jaw 112 will rotate relative to the encasing jaw 111. The first hinge 121 is a spring loaded device. The relaxed shape of the first hinge 121 holds the openwork structure 101 in the closed position 181. The first hinge 121 comprises a first post 141, a first aperture 142, and a first hinge spring 161.

Figure 9:
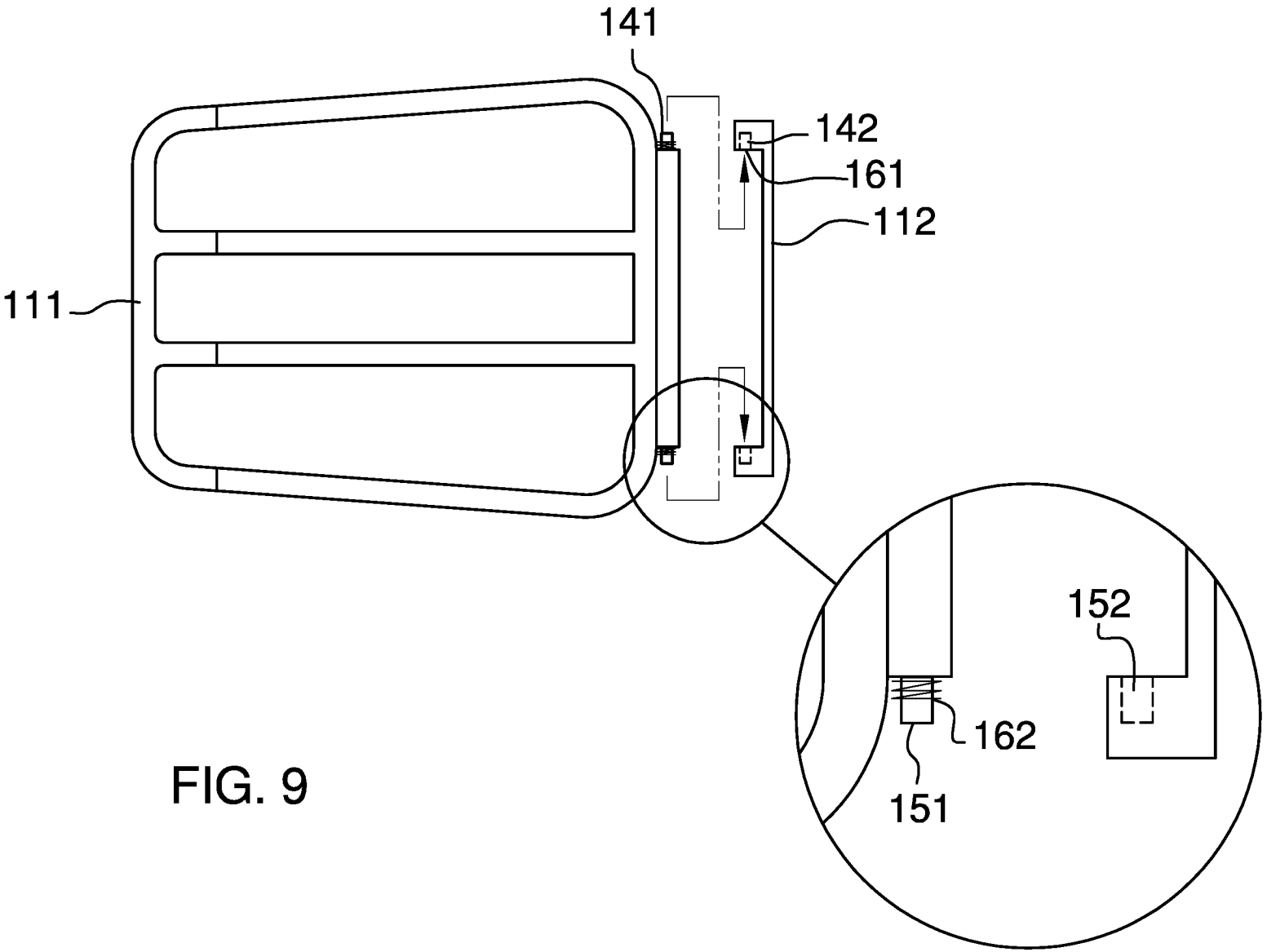
FIG. 9 is an exploded end view of an embodiment of the disclosure.

As shown most clearly in FIG. 9, the first post 141 is a cylindrical shaft that is formed on the encasing jaw 111. The first post 141 forms a pivot around which the first aperture 142 can rotate. The first aperture 142 is a cylindrically shaped cavity that is formed in the trap jaw 112. The first aperture 142 is sized such that the first post 141 can be inserted into the trap jaw 112.

The first hinge spring 161 is a torsion spring that is installed over the first post 141. The first hinge spring 161 is selected and installed such that the openwork structure 101 will be in the closed position 181 when the first hinge spring 161 is in its relaxed shape.

The second hinge 122 is a pivot based structure that attaches the encasing jaw 111 to the trap jaw 112 such that the trap jaw 112 will rotate relative to the encasing jaw 111. The second hinge 122 is a spring loaded device. The relaxed shape of the second hinge 122 holds the openwork structure 101 in the closed position 181. The second hinge 122 comprises a second post 151, a second aperture 152, and a second hinge spring 162.

As shown most clearly in FIG. 9, the second post 151 is a cylindrical shaft that is formed on the encasing jaw 111. The second post 151 forms a pivot around which the first aperture 142 can rotate. The second aperture 152 is a cylindrically shaped cavity that is formed in the trap jaw 112. The second aperture 152 is sized such that the second post 151 can be inserted into the trap jaw 112.

The second hinge spring 162 is a torsion spring that is installed over the second post 151. The second hinge spring 162 is selected and installed such that the openwork structure 101 will be in the closed position 181 when the second hinge spring 162 is in its relaxed shape.

The second post 151 is positioned relative to the first post 141 and the second aperture 152 is positioned relative to the first aperture 142 such that when the first aperture 142 inserts into the first post 141 the second aperture 152 can be simultaneously inserted into the second post 151.

To assemble the first hinge 121, the first hinge spring 161 is placed over the first post 141 and the first post 141 is inserted into the first aperture 142. To assemble the second hinge 122, the second hinge spring 162 is placed over the second post 151 and the second post 151 is inserted into the second aperture 152. To successfully attach the trap jaw 112 to the encasing jaw 111 the first hinge 121 and the second hinge 122 need to be assembled simultaneously.

The handle 103 comprises a plurality of levers that are used to move the openwork structure 101 from the closed position 181 to the open position 182. The handle 103 comprises a leverage grip 131 and a stability grip 132.

The leverage grip 131 is a hand hold that allows the invention 100 to be manipulated. The leverage grip 131 is a plate structure that is attached to the trap jaw 112. The leverage grip 131 is located between the first hinge 121 and the second hinge 122. The stability grip 132 is a hand hold that allows the invention 100 to be manipulated. The stability grip 132 is a plate structure that is attached to the encasing jaw 111. The stability grip 132 is located between the first hinge 121 and the second hinge 122.

When the leverage grip 131 and the stability grip 132 are pressed together, the openwork structure 101 moves towards the open position 182. When the leverage grip 131 and the stability grip 132 are released, the openwork structure 101 moves towards the closed position 181.

The following definitions were used in this disclosure:

Bag: As used in this disclosure, a bag is a container made of a flexible material. The bag has a single opening which allows the bag to receive the items to be contained.

Cantilever: As used in this disclosure, a cantilever is a beam or other structure that projects away from an object and is supported on only one end. A cantilever is further defined with a fixed end and a free end. The fixed end is the end of the cantilever that is attached to the object. The free end is the end of the cantilever that is distal from the fixed end.

Cavity: As used in this disclosure, a cavity is an empty space or negative space that is formed within an object.

Cushion: As used in this disclosure a cushion is a pad formed from soft material that is used for resting, sleeping, or reclining.

Force of Gravity: As used in this disclosure, the force of gravity refers to a vector that indicates the direction of the pull of gravity on an object at or near the surface of the earth.

Grip: As used in this disclosure, a grip is an accommodation formed within an object that allows the object to be grasped or manipulated by a hand.

Handle: As used in this disclosure, a handle is an object by which a tool, object, or door is held or manipulated with the hand.

Hinge: As used in this disclosure, a hinge is a device that permits the turning, rotating, or pivoting of a first object relative to a second object.

Inferior: As used in this disclosure, the term inferior refers to a directional reference that is parallel to and in the same direction as the force of gravity.

Negative Space: As used in this disclosure, negative space is a method of defining an object through the use of open or empty space as the definition of the object itself, or, through the use of open or empty space to describe the boundaries of an object.

Openwork: As used in this disclosure, the term open work is used to describe a structure, often a surface, which is formed with openings that allow for visibility and airflow through the structure. Wrought work is a form of openwork.

Orientation: As used in this disclosure, orientation refers to the positioning of a first object relative to: 1) a second object; or, 2) a fixed position, location, or direction.

Pad: As used in this disclosure, a pad is a mass of soft material used as a filling or for protection against damage or injury. Commonly used padding materials include, but are not limited to, polyurethane foam, silicone, a polyester fill often referred to as fiberfill or polystyrene beads often referred to as stuffing beans or as bean bag chair beans.

Perimeter: As used in this disclosure, a perimeter is one or more curved or straight lines that bounds an enclosed area on a plane or surface. The perimeter of a circle is commonly referred to as a circumference.

Pillow: As used in this disclosure, a pillow is a rectangular cushion that is used to support the head.

Pillow Case: As used in this disclosure, a pillow case is a textile bag that is used to contain a pillow.

Pivot: As used in this disclosure, a pivot is a rod or shaft around which an object rotates or swings.

Relaxed Shape: As used in this disclosure, a structure is considered to be in its relaxed state when no shear, strain, or torsional forces are being applied to the structure.

Rim: As used in this disclosure, a rim is an outer edge or border that follows along the perimeter of an object.

Spring: As used in this disclosure, a spring is a device that is used to store mechanical energy. This mechanical energy will often be stored by: 1) deforming an elastomeric material that is used to make the device; 2) the application of a torque to a rigid structure; or 3) a combination of the previous two items.

Superior: As used in this disclosure, the term superior refers to a directional reference that is parallel to and in the opposite direction of the force of gravity.

Torsion Spring: As used in this disclosure, a torsion spring is a mechanical device that stores mechanical energy through an opposing torque when the mechanical device is twisted. The torsion spring will return to its original relaxed shape when the twisting force is removed.

Tray: As used in this disclosure, a tray is a flat plate like structure that has a raised rim formed around the perimeter for the purpose of containing fluids within the structure of the tray. Trays will generally give an impression of being a shallow containment device. Trays are often used for carrying food and drink or for holding small items.

With respect to the above description, it is to be realized that the optimum dimensional relationship for the various components of the invention described above and in FIGS. 1 through 9 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A holder that facilitates the making of a bed comprising:

an openwork structure, a plurality of hinges, and a handle;

wherein the plurality of hinges and the handle are attached to the open work structure;

wherein the plurality of hinges open and close the openwork structure;

wherein the handle is an apparatus that controls the holder that facilitates the making of a bed;

wherein the holder that facilitates the making of a bed is configured for use with a pillow;

wherein the holder that facilitates the making of a bed is configured for use with a pillow case;

wherein the holder that facilitates the making of a bed inserts the pillow into the pillow case;

wherein the openwork structure is a container within which the pillow is placed before being inserted into the pillow case;

wherein the openwork structure comprises an encasing jaw and a trap jaw;

wherein the trap jaw attaches to the encasing jaw;

wherein the openwork structure is further defined with a closed position and an open position;

wherein the trap jaw is further defined with a lip;

wherein the structure of the trap jaw is formed in the shape of a tray;

wherein the lip is a rim formed around the perimeter of the tray;

wherein the lip of the trap jaw is formed such that the pillow will slide off the trap jaw when the trap jaw is experiencing constant motion;

wherein the lip of the trap jaw is formed such that the pillow will not fall off the trap jaw when the trap jaw is experiencing constant motion;

wherein the trap jaw is placed on the encasing jaw such that the lip projects away from the surface of the trap jaw towards the encasing jaw; wherein the pillow inserts into the openwork structure;

wherein the openwork structure containing the pillow is placed in the closed position;

wherein the openwork structure containing the pillow inserts into the pillow case;

wherein the orientation of the holder that facilitates the making of a bed relative to the force of gravity is inverted such that the trap jaw forms the inferior surface of the holder that facilitates the making of a bed;

wherein the openwork structure is placed in the open position; wherein the openwork structure is withdrawn leaving the pillow in the pillow case;

wherein each of the plurality of hinges is a spring-loaded apparatus;

wherein each of the plurality of hinges holds the openwork structure together;

wherein each of the plurality of hinges allows the openwork structure to open and close as required;

wherein the structure of each of the plurality of hinges is distributed between the encasing jaw and the trap jaw;

wherein the plurality of hinges comprises a first hinge; wherein the first hinge is a pivot based structure;

wherein the first hinge attaches the encasing jaw to the trap jaw such that the trap jaw will rotate relative to the encasing jaw;

wherein the relaxed shape of the first hinge holds the openwork structure in the closed position;

wherein the plurality of hinges comprises a second hinge; wherein the second hinge is a pivot based structure;

wherein the second hinge attaches the encasing jaw to the trap jaw such that the trap jaw will rotate relative to the encasing jaw;

wherein the relaxed shape of the second hinge holds the openwork structure in the closed position.

2. The holder that facilitates the making of a bed according to claim 1 wherein the first hinge comprises a first post, a first aperture, and a first hinge spring;

wherein the first post inserts into the first hinge spring;

wherein the first post inserts into the first aperture;

wherein the second hinge comprises a second post, a second aperture, and a second hinge spring;

wherein the second post inserts into the second hinge spring;

wherein the second post inserts into the second aperture.

3. The holder that facilitates the making of a bed according to claim 2 wherein the first post is a cylindrical shaft;

wherein the first post is formed on the encasing jaw;

wherein the second post is a cylindrical shaft;

wherein the second post is formed on the encasing jaw.

4. The holder that facilitates the making of a bed according to claim 3 wherein the first aperture is a cylindrically shaped cavity that is formed in the trap jaw;

wherein the first aperture is sized such that the first post can be inserted into the trap jaw;

wherein the second aperture is a cylindrically shaped cavity that is formed in the trap jaw;

wherein the second aperture is sized such that the second post can be inserted into the trap jaw.

5. The holder that facilitates the making of a bed according to claim 4 wherein the first hinge spring is a torsion spring;

wherein the first hinge spring is installed over the first post;

wherein the first hinge spring is in the closed position when the first hinge spring is in its relaxed shape;

wherein the second hinge spring is a torsion spring;

wherein the second hinge spring is installed over the second post;

wherein the second hinge spring is in the closed position when the second hinge spring is in its relaxed shape.

6. The holder that facilitates the making of a bed according to claim 5 wherein the handle comprises a leverage grip and a stability grip;

wherein the leverage grip is a hand hold that allows the holder that facilitates the making of a bed to be manipulated;

wherein the leverage grip is a plate structure that is attached to the trap jaw;

wherein the leverage grip is located between the first hinge and the second hinge;

wherein the stability grip is a hand hold that allows the holder that facilitates the making of a bed to be manipulated;

wherein the stability grip is a plate structure that is attached to the encasing jaw;

wherein the stability grip is located between the first hinge and the second hinge.

7. The holder that facilitates the making of a bed according to claim 6 wherein when the leverage grip and the stability grip are pressed together, the openwork structure moves towards the open position;

wherein when the leverage grip and the stability grip are released, the openwork structure moves towards the closed position.

* * * * *